United States Patent [19]

Schleinkofer

[11] 4,189,658

[45] Feb. 19, 1980

[54] ROTATING ANODE X-RAY TUBE

[75] Inventor: Rudolf Schleinkofer, Erlangen, Fed. Rep. of Germany

[73] Assignee: Siemens Aktiengesellschaft, Berlin & Munich, Fed. Rep. of Germany

[21] Appl. No.: 834,477

[22] Filed: Sep. 19, 1977

[30] Foreign Application Priority Data

Oct. 14, 1976 [DE] Fed. Rep. of Germany ..... 2646454

[51] Int. Cl.[2] ..... H01J 35/08

[52] U.S. Cl. ..... 313/330; 313/60

[58] Field of Search ..... 313/330, 311, 60

[56] References Cited

U.S. PATENT DOCUMENTS

| | | | |
|---|---|---|---|
| 3,710,170 | 1/1973 | Friedel | 313/330 |
| 3,819,971 | 6/1974 | Kaplan et al. | 313/330 |
| 3,900,751 | 8/1975 | Holland et al. | 313/330 |
| 3,959,685 | 5/1976 | Konieczynski | 313/330 |

*Primary Examiner*—Saxfield Chatmon, Jr.

*Attorney, Agent, or Firm*—Hill, Van Santen, Steadman, Chiara & Simpson

[57] ABSTRACT

In a specific illustrated embodiment the upper metal part of the rotating anode which carries the X-ray emitting material at its upper surface is provided with a graphite disc soldered to its lower surface. For accommodating rotational balancing of the anode assembly, the graphite disc is provided with an array of recesses receiving equilibration members of molybdenum. As an example, where the lower heat radiating surface of graphite has a diameter of 100 mm, four discs of molybdenum may be equally spaced about the axis of rotation and have diameters of about 15 mm so as to provide sufficient mass for compensating imbalances and of a size capable of being worked for example by drilling. The equilibration inserts may have flanges at their upper surfaces contacting the anode proper so as to key the inserts into conforming recesses of the graphite disc.

10 Claims, 3 Drawing Figures

ROTATING ANODE X-RAY TUBE

BACKGROUND OF THE INVENTION

The invention relates to a rotating anode X-ray tube. As is known, rotating anodes of X-ray tubes must be balanced in order to operate on account of their high rotational rate. In addition, a uniform distribution of the mass is necessary in order to avoid a load-impact on the bearings leading to premature attrition, and also in order to achieve an adequate life of the tube.

In the German Offenlegungsschrift No. 2,249,184, a rotating anode for X-ray tubes is described wherein balancing or equilibration is achieved without damage to the anode body and without the related disadvantages. In order to do this, the distribution of the mass of the anode body is compensated by coating restricted surfaces with metal. Thus, a smooth operation can be achieved even when there is a high number of revolutions per second. However, in so doing, it has been shown that there is a considerable resulting outlay, particularly for rebalancing which repeatedly becomes necessary. Particularly in the case of anodes with graphite parts, it is a disadvantage that the adherence of metal platings may be insufficient given high centrifugal forces (300 Hz-rotation of the anode plates). The material to be applied must have at least approximately the same thermal expansion as the graphite in order for the applied material to permanently adhere and not break off on account of the stresses of thermal cycling occurring in X-ray tubes, as well as to be able to withstand the substantially greater temperatures produced during manufacture; i.e., during degassing.

SUMMARY OF THE INVENTION

In the case of a rotating anode for an X-ray tube, the object which is the basis of the invention consists in achieving reliable balancing in a simple fashion and with means which are readily controllable mechanically.

If a number of parts are introduced in a present conventional discoid rotating anode, said parts being disposed about the rotational axis in a rotationally symmetrical, dynamically balanced fashion, and if these parts consist of a material which, in addition to possessing the standard properties necessary in tubes, such as high temperature resistance, low vapor pressure, etc., also manifests a good mechanical workability, such as a capability for spot-drilling, it is possible to utilize as the actual anode material a material of such a type which is indeed controllable during fabrication, but which can subsequently only be worked with difficulty, without having to take into account disadvantages regarding the emission of loose particles, gas eruptions in high vacuum, etc.

A material of this type which is favorable per se for rotating anodes is obviously graphite. Anodes made of this material can indeed be manufactured during fabrication according to required dimensions and, after a corresponding preliminary treatment, they may also be used in X-ray tubes. However, should balancing become necessary, the graphite body must be broken open, so that rough locations, etc., result which may bring about an impairment of the tube as stated above. This can be avoided if, in accordance with the invention, equilibration parts are inserted in the anode in advance. The equilibration members may consist of a metal which is stable in a vacuum and can be readily worked mechanically, such as molybdenum or molybdenum alloys. Equilibration members such as this can be modified in their mass in a reductive fashion, e.g. by means of spot-drilling, in order to compensate imbalances.

The inventive procedure is of particular importance in the case of rotating anodes composed of several discs (or plates). In a known embodiment, a metal plate is coated with parts consisting of graphite on its lower side and possibly on its upper side except for the focal spot orbit in order to increase the thermal radiation. However, only the surface of the graphite is then available for balancing the completed anode, because, as is known, the focal spot orbit cannot be used for balancing purposes. In accordance with its function, it must be as smooth as possible; i.e., it cannot manifest any removal areas, such as holes, etc. However, the conventional balancing of anode plates which is effected on the lower side could cause damage to the graphite member soldered on at that location.

In order to avoid the cited disadvantage, the invention specifies that a number of equilibration metal elements can be placed in the graphite member. Holes may be provided in the graphite plate in order to secure these metal elements. When the graphite disc (or plate) is soldered to the metal disc (or plate), the equilibration metal elements placed in the holes are then simultaneously soldered in the graphite disc (or plate) so as to be unified with the metal anode plate. The equilibration elements can be additionally secured if they have a larger diameter at the end disposed at the soldered-on side of the graphite plate, said enlarged diameter being, for example, in the form of a rim; i.e., a flange which extends laterally, and which prevents the equilibration elements from slipping out of the holes into which they have been placed.

Basically, three equilibration elements already make possible a satisfactory compensation of the mass distribution, because the plane of the plate is clearly defined by three points, and every imbalance randomly disposed in said plane can be detected with three balancing weights. However, as a rule, four equilibration members would be expedient, because division of the unbalanced mass-components into a right-angled coordinate system is of particular advantage in the case of a series-equilibration. (According to the watt meter-method, imbalances are separated into two components perpendicular to one another.) Equilibration should also be possible with more than four members. However, the disadvantage that the radiating surface may become too small could occur in this instance.

The equilibration members may manifest any random form per se if they are capable of being placed (or inserted) in the anode arrangement. Round discs have been proven expedient, for they are easy to manufacture, on the one hand, and the insertion openings can also be readily obtained to a sufficient degree of precision, on the other hand. Suitable dimensions for the insertions have been found to be those in a range of 10 to 20 millimeters, particularly, 15 mm, given a plate diameter of 100 mm, corresponding to a ratio to the diameter of the rotating anode of 20:100 to 10:100; particularly, 15:100. Through the cited selection, a ratio of the radiating graphite surface to the equilibration metal surface available for an equilibrating removal (or reduction) is obtained which leaves open sufficient possibilities for both functions. On the one hand, as little as possible of the radiating graphite surface is to be lost; on the other hand, however, it is necessary for the equilibration metal parts to be processed to be sufficiently massive so that they provide enough material for compensating expected imbalances, on the one hand, and are capable of being worked by tools effecting a removal (or a reduction), on the other hand.

The actual operation of equilibration consists in conventionally ascertaining an imbalance on corresponding machines, and then producing the rotational balance (or equilibrium) by a process of removal carried out on the inserted members disposed in proximity to the excessive collected mass. Material can be removed from the inserted metal parts in a simple fashion by means of spot-drilling.

Other objects, features and advantages of the invention will be apparent from the following detailed description taken in connection with the accompanying sheet of drawings.

DESCRIPTION OF A PREFERRED EMBODIMENT

Figure 1:
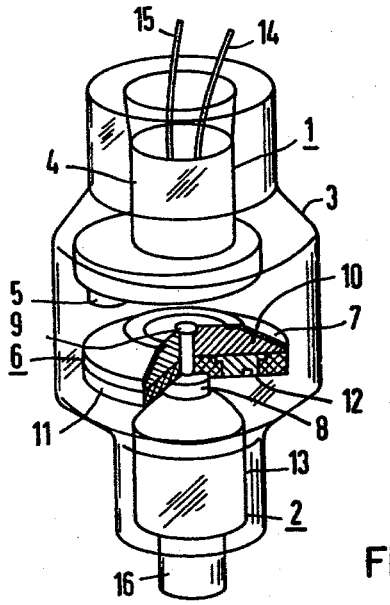
FIG. 1 illustrates the diagram of an X-ray tube whose anode is equipped as specified by the invention.

In FIG. 1, a rotating anode X-ray tube is illustrated in which a cathode arrangement 1 is disposed opposite an anode arrangement 2 in a glass vacuum tube. The cathode arrangement 1 is supported with an attachment sleeve 4 on the interior side of the tube. It exhibits an extension 5 containing a thermionic cathode not visible in the figure, which can emit electrons which impinge upon the actual rotating anode 6 on a focal spot orbit covered with tungsten as indicated at 7 and having a thickness of 1.3 mm. Rotating anode 6 is mounted on shaft 8 by means of a screw 9. The rotating anode itself consists of an upper metal plate 10, approximately 10 mm thick and composed of molybdenum, which is coated on the focal spot orbit with an approximately 1.5 mm-thick tungsten alloy containing 5% rhenium; i.e., consisting of so-called RTM material having a diameter of approximately 100 mm. A 9 mm-thick graphite plate 11 is soldered onto the lower side of plate 10. In the body of plate 11, equilibration members consisting of molybdenum are inserted, that particular equilibration member designated with reference numeral 12 being visible in FIG. 1. The entire anode is placed in rotational movement in a known fashion via rotor 13 when, by connecting a voltage between the connections 14 and 15, electrons are emitted from the thermionic cathode onto the focal spot orbit 7. These electrons are accelerated through an electric field which results from an electric potential applied between one of the connections 14 or 15 and the connection piece 16.

Figure 2:
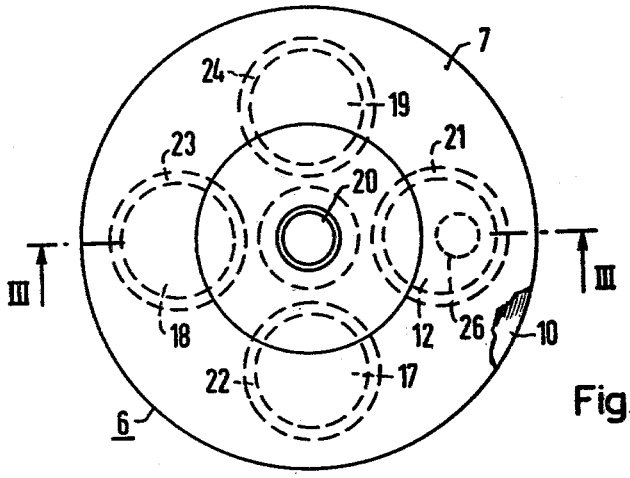
FIG. 2 illustrates an enlarged plan view of the anode of FIG. 1.

FIG. 2 illustrates a plan view of anode 6. Equilibration members 12 and 17 through 19, inserted in graphite plate 11, are illustrated by broken lines, the equilibration members being round discs having a diameter of 15 mm. In their length they are matched to the thickness of plate 11. The spacial interval of their centers from the edge of plate 11 amounts to 14 mm. The selection of the dimensions make it possible for sufficient material to be present in order to be able to compensate the imbalances occurring during the manufacture of the anodes, on the one hand, and for the radiating surface remaining on the graphite disc not to be excessively reduced, on the other hand.

A larger diameter of members 12 and 17 through 19, exceeding 15 mm of the present example at the lower surface, would have as its consequence a reduction of the radiating surface. A diameter falling short of 15 mm leads to the expectation that insufficient material would be present in order to compensate imbalances occurring. In the example, the diameter of 15 mm is selected, given a diameter of the plate 11 of 100 mm. The radiating surface of plate 11 is thereby impaired only to such an extent that the bodies 12 and 17 through 19 are provided with the mass which is adapted to the possible imbalances to be compensated, on the one hand, and that they are large enough, on the other hand, in order to be capable of being worked in a reductive fashion with conventional tools such as a drill, for example.

Figure 3:
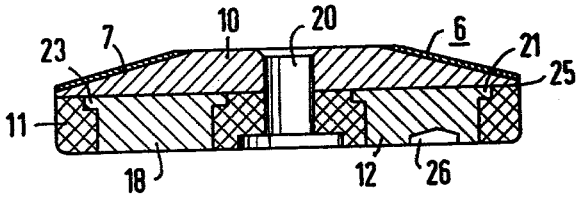
FIG. 3 illustrates a sectional view obtainable by cutting along the line III—III in FIG. 2.

In FIGS. 2 and 3, a central opening 20 is additionally apparent into which shaft 8 is inserted. On the upper side of anode 6, opening 20 manifests a lateral expansion (see FIG. 3) into which the head of screw 9 engages for the purpose of securing the anode 6 to the shaft 8. On the other hand, the double broken lines illustrating the boundaries of members 12 and 17 through 19 indicate that they have a lateral edge or flange. The edge can be more readily seen from the sectional view of FIG. 3. The edges designated with 21 through 24 protrude 1 mm beyond the lateral edge of the equilibration members 12 and 17 through 19 and are 2 mm thick. They represent a thickening (or enlargement) of the members at their end disposed near the soldering seam (or joint) 25. Since the recesses in plate 11 are precisely adapted to the shape of the equilibration members, an additional positive locking support is thus achieved.

Equilibration of anode 6 proceeds in a known fashion. For this purpose, the anode is placed in rotation in a balancing machine. Impairments of the circular operation occurring due to irregular distribution of the mass can be read-off on the machine according to location and magnitude. This provides the possibility of effecting corresponding changes on one of the equilibration members 12 and 17 through 19. In the present figure, an excess weight can be determined in the vicinity of equilibration member 12. The latter (excess weight) is then compensated by introduction of a bore-hole 26 whose depth and diameter is adapted to the amount of material to be removed.

It will be apparent that many modifications and variations may be effected without departing from the scope of the novel concepts and teachings of the present invention.

I claim as my invention:

1. A rotating anode for an X-ray tube comprising a rotary anode body having equilibration means applied for the purpose of rotational balancing, characterized in that the rotary anode body comprises a composite construction including a metal disc having a focal spot orbit thereon, and further material secured with said metal disc and having a plurality of recesses at equal spacial intervals from one another and at equal spacial intervals from the center of said rotary anode body, the equilibration means comprising equilibration members inserted in said recesses in said further material of the rotary anode body, said equilibration members being accessible for modification in a reductive fashion without damage to the anode to a degree sufficient to compensate for imbalances.

2. A rotating anode for an X-ray tube according to claim 1, characterized in that the rotary anode body comprises a plurality of discs, and that the equilibration members are inserted at least in one of the discs disposed at the exterior of said rotary anode body.

3. A rotating anode for an X-ray tube according to claim 2, characterized in that the rotary anode body comprises a metal disc on whose upper side the focal spot orbit is located and on whose lower side a graphite disc is applied into which the equilibration members are inserted.

4. A rotating anode for an X-ray tube according to claim 1, characterized in that four equilibration members are inserted at equal spacial intervals from one another and at equal spacial intervals from the center of said rotary anode body.

5. A rotating anode for an X-ray tube according to claim 1, characterized in that the rotary anode body comprises a metal disc having a focal spot orbit on an upper side thereof, and a graphite disc secured to the lower side of said metal disc, said graphite disc having four of said recesses at equal spacial intervals from one another and at equal spacial intervals from the center thereof, said equilibration means comprising four of said equilibration members inserted in the respective recesses of said graphite disc.

6. A rotating anode for an X-ray tube according to claim 5, characterized in that the equilibration members are circular discs whose diameters are in a ratio to the diameter of the graphite disc within the range from about 20:100 to about 10:100.

7. A rotating anode for an X-ray tube according to claim 1, characterized in that the rotary anode body has walls defining said recesses which are in conforming contact with the equilibration members, the shape of said recesses and the shape of said equilibration members being such as to provide a positive locking support of the equilibration members with the rotary anode body.

8. A rotating anode according to claim 1 with said rotary anode body comprising a metal disc having a focal spot orbit on an upper surface thereof, and a graphite disc secured in contact with a lower side of said metal disc, said graphite disc having interior walls defining said recesses which receive said equilibration members, the shape of said recesses and of said equilibration members being such as to provide a positive locking support of the equilibration members with the rotary anode body.

9. A rotating anode according to claim 8, characterized in that the equilibration members have a flange which is laterally thickened to form a rim at that end of the equilibration members adjacent the metal disc to provide for locking of the equilibration members between the metal disc and the graphite disc.

10. A rotating anode according to claim 1, characterized in that said equilibration members are of high temperature resistant material accessible for modification in a reductive fashion without damage to the anode to a degree sufficient to compensate for imbalances occurring during manufacture.

* * * * *